US005683272A

United States Patent [19]

Abe

[11] Patent Number: 5,683,272

[45] Date of Patent: Nov. 4, 1997

[54] PRESSURE-CONTACT CONNECTOR

[75] Inventor: Kimihiro Abe, Shizuoka, Japan

[73] Assignee: Yazaki Corporation, Tokyo, Japan

[21] Appl. No.: 561,807

[22] Filed: Nov. 22, 1995

[30] Foreign Application Priority Data

Nov. 22, 1994 [JP] Japan ..... 6-288182

[51] Int. Cl.[6] ..... H01R 13/432

[52] U.S. Cl. ..... 439/747; 439/456; 439/598; 439/752.5; 439/467

[58] Field of Search ..... 439/747, 595, 439/752, 752.5, 686, 695, 407, 598, 680

[56] References Cited

U.S. PATENT DOCUMENTS

| | | | |
|---|---|---|---|
| 3,853,389 | 12/1974 | Occhipinti | 439/747 |
| 4,346,959 | 8/1982 | Daugherty et al. | 439/747 |
| 5,071,369 | 12/1991 | Denlinger et al. | 439/598 |
| 5,190,477 | 3/1993 | Akeda | 439/595 |
| 5,201,674 | 4/1993 | Okura | 439/595 |
| 5,312,276 | 5/1994 | Hnatuck et al. | 439/701 |
| 5,316,497 | 5/1994 | Topolewski et al. | 439/752 |
| 5,380,220 | 1/1995 | Okabe | 439/595 |

FOREIGN PATENT DOCUMENTS

| | | | |
|---|---|---|---|
| 61-8952 | 1/1986 | Japan | H01R 4/24 |
| 4-136870 | 12/1992 | Japan | H01R 4/24 |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

Respective terminals are received in terminal accommodating chambers in the direction of arrow A from the front of a connector body, respectively. Then, stabilizers and lances of the terminals are locked in first and second grooves of the respective terminal accommodating chambers, so that the terminals are surely positioned in predetermined positions in the terminal accommodating chamber. Projecting portions provided integrally with the connector body lock the terminals in the predetermined positions to thereby prevent the terminals from moving in the direction of arrow A. Electric wires pressure-contacted to the terminals are bent in accordance with the outer shapes of the projecting portions, so that the electric wires are restrained from moving in the direction of arrow A. Accordingly, the electric wires are surely prevented from coming off backward out of the terminals.

4 Claims, 8 Drawing Sheets

PRESSURE-CONTACT CONNECTOR

BACKGROUND OF THE INVENTION

1. Field of the Invention

The present invention relates to pressure-contact connectors for use in wire harnesses for cars, or the like, and, particularly, relates to the structure of a pressure-contact connector for holding terminals and electric wires in a connector body surely.

2. Related Art

As a conventional pressure-contact connectors, known is that disclosed in JP-U-61-8952, etc. That is, as shown in FIGS. 12 and 13, a lock portion 52 and a lead-wire holding concave/convex portion 53 are provided in each of lead-wire holding pieces 51 which can be opened and closed through a hinge 50. Thus, if the respective lock portions 52 of the lead-wire holding pieces 51 are fitted to each other, a lead wire 54 is held between the respective lead-wire holding concave/convex portion 53. A lance 56 is locked at a step portion 58 of a connector housing 57 so that a terminal 55 is restrained from moving to the insertion side of the lead wire 54 and prevented from coming off out of the connector housing 57. In addition, being held between the respective lead-wire holding concave/convex portions 53, the lead wire 54 is restrained from moving and prevented from rearwardly withdrawn from the terminal 55.

Further, as another conventional pressure-contact connector, known is that disclosed in JP-B-4-136870, etc. That is, as shown in FIGS. 14 and 15, upper and lower connector housings 61 and 62 are put on one another through a cover 60 and assembled in a predetermined positional relationship through engagement between projections 72, 73, 74 and associated grooves 63, 75, 76 provided therein. Terminal reception chambers 65 for receiving pressure-contact terminals 64 are provided in the connector housings 61 and 62, and terminal lock portions 66 for restraining the pressure-contact terminals 64 from moving are provided in the terminal reception chambers 65. In addition, a projection 67 is provided in an end portion of the cover 60, and terminal lock surfaces 68 for restraining the pressure-contact terminals 64 from moving are formed in the front portion of the projection 67.

The pressure-contact terminals 64 are locked by the terminal lock portions 66 of the connector housings 61 are 62 and the terminal lock surfaces 68 of the cover 60 respectively so that the terminals 64 are restrained from moving. Accordingly, the pressure-contact terminals 64 are locked in the predetermined positions in the terminal reception chambers 65, and are prevented from being loosened in the respective terminal reception chambers 65. In addition, electric wires 69 pressure-contacted to the pressure-contact terminals 64 are bent along the outer shape of the projection 67 of the cover 60, and are held between the rear portion of the projection 67 of the cover 60 and rear edges 70 of the connector housings 61 and 62 respectively so that the electric wires 69 are prevented from coming off out of the pressure-contact terminals 64.

However, of the above-mentioned conventional pressure-contact connectors, the former one shown in FIGS. 12 and 13 requires a complicated process particularly in forming the respective lead- wire holding concave/convex portions 53. As a result, it is difficult to reduce the cost. In addition, since the respective lead-wire pieces 51 are locked only by the fitting of the lock portions 52 to each other, the force with which the respective lead-wire holding concave/convex portions 53 hold the lead wire 54 is insufficient. Accordingly, there has been a problem that, for example, when a tensile force acts on the lead wire 54, it is impossible to prevent the lead wire 54 from being removed from the terminal 55.

In addition, the terminal 55 is prevented from withdrawing from the connector housing 57 only by the engagement between the lance 56 and the step portion 58 of the connector housing 57. There has been therefore a problem that, for example, when a tensile force acts on the lead wire 54, the lock state of the terminal 55 becomes so unstable as to produce contact failure, or the like.

On the other hand, the latter pressure-contact connector shown in FIGS. 14 and 15 can prevent the pressure-contact terminals 64 from being loosening in the terminal reception chambers 65, can prevent the electric wires 69 from coming off out of the pressure-contact terminals 64, and so on. That is, the electric wires 69 is prevented from being rearwardly withdrawn from the pressure-contact terminals 64 by a so-called strain relief structure where the electric wires 69 are bent along the outer shape of the projection 67 of the cover 60 so as to be held between the rear portion of the projection 67 and the rear edges of the connector housings 61 and 62. Accordingly, it is necessary to form the cover 60 having the projection 67 separately from the connector housings 61 and 62.

That is, since the pressure-contact terminals 64 are stored in the terminal reception chambers 65 in the same direction as the direction of insertion of the electric wires 69, it is impossible to install the pressure-contact terminals 64 and the electric wires 69 into the connector housings 61 and 62 if the projection 67 for bending the electric wires 69 exists when the pressure-contact terminals 64 and the electric wires 69 are to be installed. Therefore, the cover 60 for forming the projection 67 must be another member provided separately from the connector housings 61 and 62.

In addition, the projections and grooves 63 for mounting the cover 60 onto the respective connector housings 61 and 62 must be provided in predetermined positions in the respective connector housings 61 and 62 and the cover 60. It is therefore inevitable to make the shape complicated and increase the number of assembling steps and the number of parts. Accordingly, it has been difficult to reduce the connector in size as well as in cost.

Further, since it is necessary to install the upper and lower connector housings 61 and 62 and the cover 60 with a predetermined positional relationship, there has been a problem that the working of installation needs much labor and time.

SUMMARY OF THE INVENTION

It is an object of the present invention to provide a pressure-contact connector in which terminals and electric wires can be held in a connector body surely, and in which the number of parts and the number of assembling steps can be reduced to thereby realize the reduction of the connector in size as well as in cost.

The foregoing object of the present invention can be attainted by a pressure-contact connector wherein a plurality of terminals into which electric wires are to be pressed-contacted are inserted into a plurality of terminal reception chambers provided in a connector body from the front side of the connector body, and wherein positioning means for positioning the terminals in predetermined positions in the terminal reception chambers are provided in the terminals and the connector body.

Preferably, the positioning means are constituted by first and second claw portions provided in the terminals, and first and second lock grooves provided in the terminal reception chambers of the connector body for locking the first and second claw portions respectively, so that the first claw portion is locked by the first lock groove to be thereby restrained from moving in the direction of insertion while the second claw portion is locked by the second lock groove to be thereby restrained from moving in the direction opposite to the direction of insertion, whereby the terminals are positioned in predetermined positions in the terminal reception chambers.

Preferably, projecting portions are integrally provided on rear ends of the terminal reception chambers of the connector body on the side of pressure-insertion of the electric wires so that the projecting portions project in a direction intersecting the direction of insertion of the electric wires, whereby the terminals are restrained from moving backward by the projecting portions and the electric wires connected to the terminals are prevented from coming off backward.

Further preferably, floating preventing pieces which can fit to the projecting portions respectively are provided at rear ends of the terminals.

In a pressure-contact connector designed thus according to the present invention, a plurality of terminals into which electric wires are to be pressed-contacted are inserted into a plurality of terminal reception chambers provided in a connector body from the front side of the connector body, and wherein positioning means for positioning the terminals in predetermined positions in the terminal reception chambers are provided in the terminals and the connector body. Accordingly, the plurality of terminals are inserted into the terminal reception chambers from the front side of the connector body, and surely held in predetermined positions in the terminal reception chambers by the positioning means provided in the connector body and the terminals.

In addition, the positioning means are constituted by first and second claw portions provided in the terminals, and first and second lock grooves provided on the connector body. Accordingly, the first claw portion is locked by the first lock groove to be thereby restrained from moving in the direction of insertion while the second claw portion is locked by the second lock groove to be thereby restrained from moving in the direction opposite to the direction of insertion. Consequently, the terminals are positioned in predetermined positions in the terminal reception chambers surely.

In addition, projecting portions are integrally provided on rear ends of the terminal reception chambers of the connector body on the side of pressure-insertion of the electric wires so that the projecting portions project in a direction intersecting the direction of insertion of the electric wires. Accordingly, .not only the terminals are restrained from moving backward by the projecting portions, but also the projecting portions form electric wire bending portions to thereby prevent the electric wires connected to the terminals from coming off backward.

Further, floating preventing pieces which can fit to the projecting portions respectively are provided at the rear ends of the terminals. Accordingly, the terminals are fitted to the projecting portions of the connector body so as to be restrained from floating in the direction intersecting the direction of insertion of the electric wires. At the same time, it is possible to surely prevent the electric wires from backward coming off even if a tensile force acts on the electric wires.

DETAILED DESCRIPTION OF THE PREFERRED EMBODIMENTS

Figure 1:
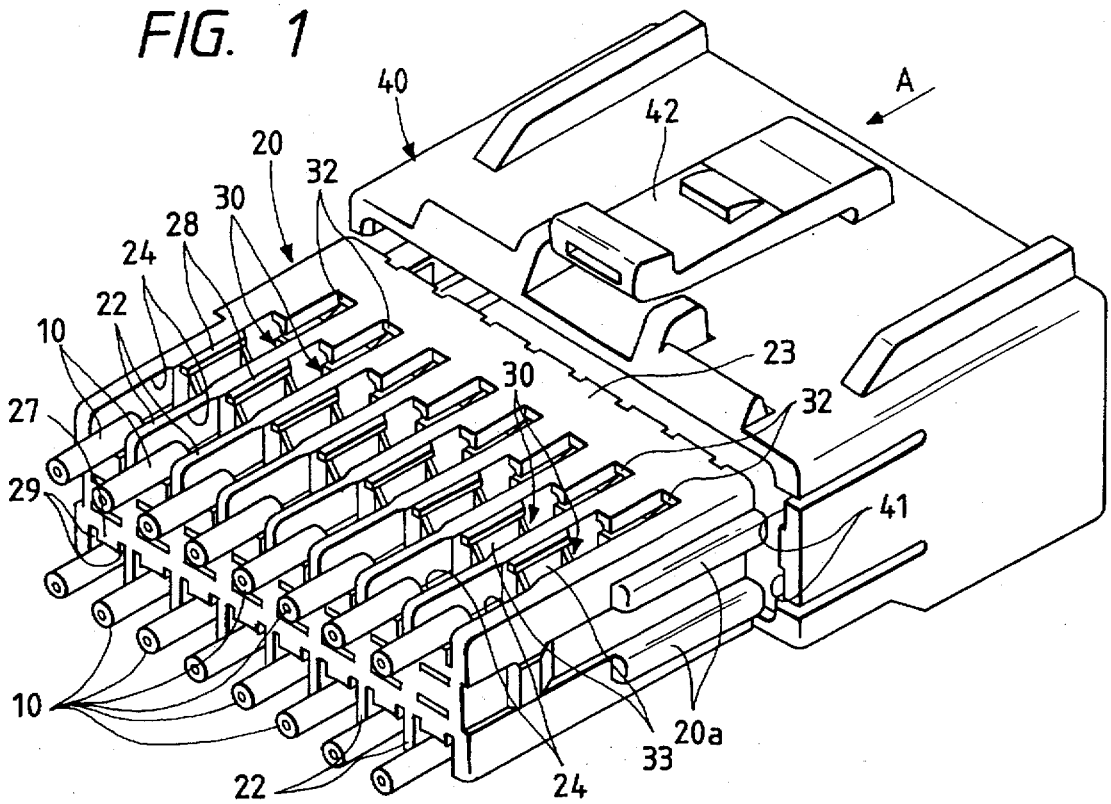
FIG. 1 is a perspective view illustrating an embodiment of a pressure-contact connector according to the present invention, where a cover is not fitted.
Figure 2:
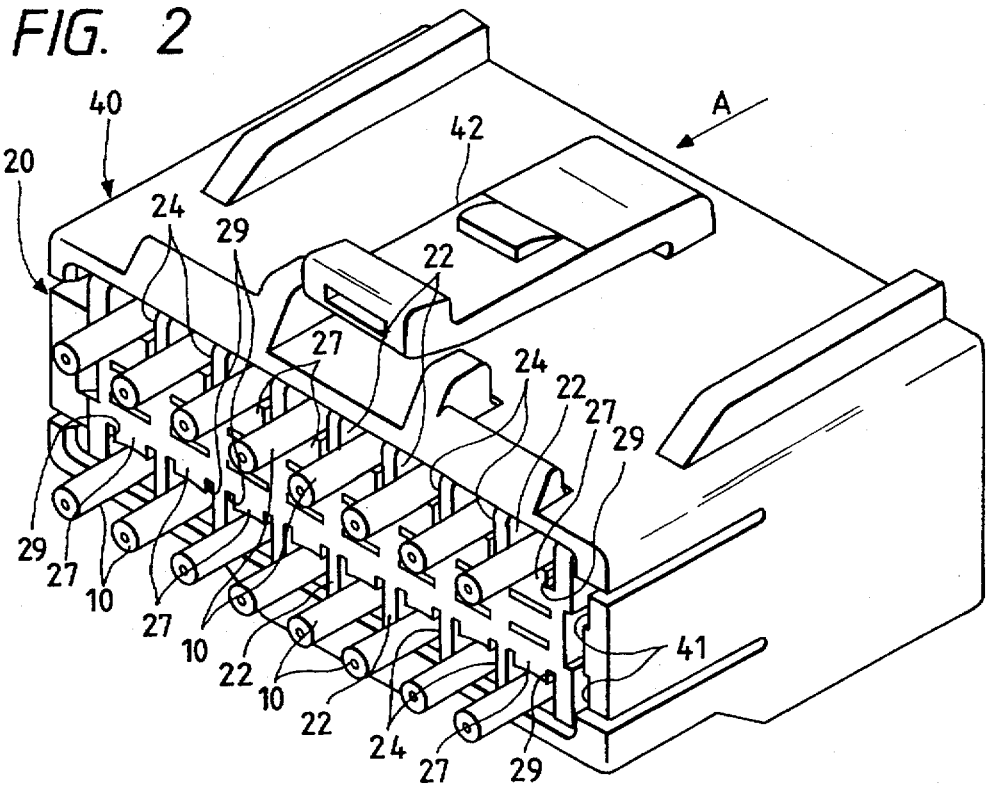
FIG. 2 is a perspective view illustrating the state after a cover is fitted in FIG. 1.
Figure 3:
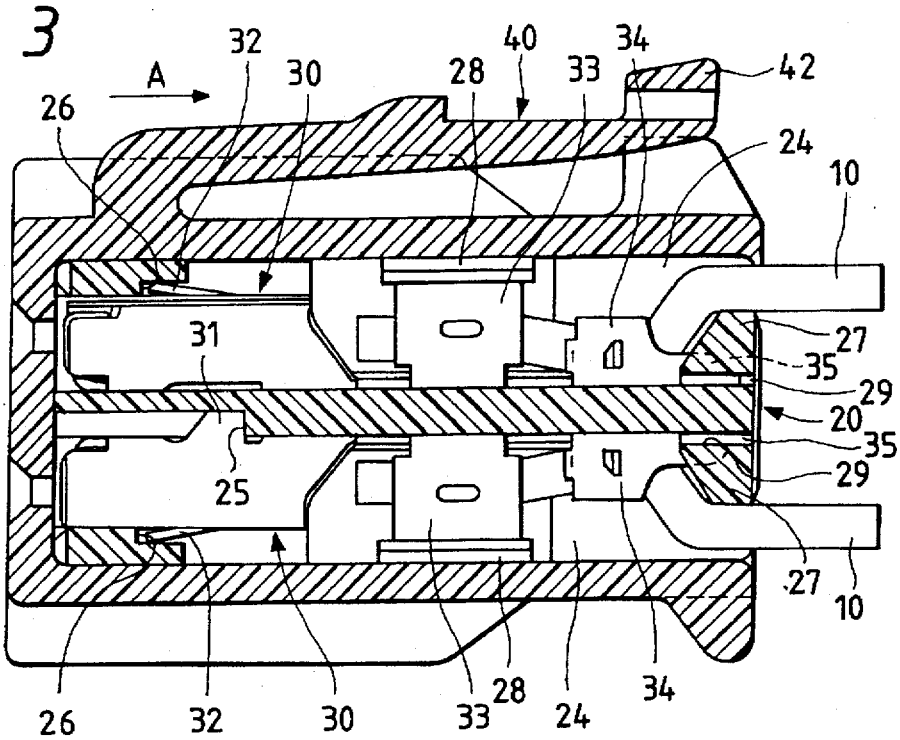
FIG. 3 is a sectional view in FIG. 2.

An embodiment of the pressure-contact connector according to the present invention will be described in detail with reference to FIGS. 1 to 10. FIG. 1 is a perspective view illustrating an embodiment of the pressure-contact connector according to the present invention, where a cover is not fitted yet; FIG. 2 is a perspective view illustrating the same pressure-contact connector where the cover has been fitted thereinto in FIG. 1; and FIG. 3 is a sectional view illustrating the state in FIG. 2. As shown in these drawings, a plurality of terminals 30 to which electric wires 10 are to be pressure-connected are respectively received in terminal reception chambers 24 in the direction of arrow A from the front side of a connector body 20 which is opposite to the insertion side of the electric wires 10, so that the terminals 30 are positioned in predetermined positions in the respective terminal reception chambers 24. Then, a cover 40 is fitted onto the connector body 20 from the front side thereof in the direction of arrow A.

Figure 4:
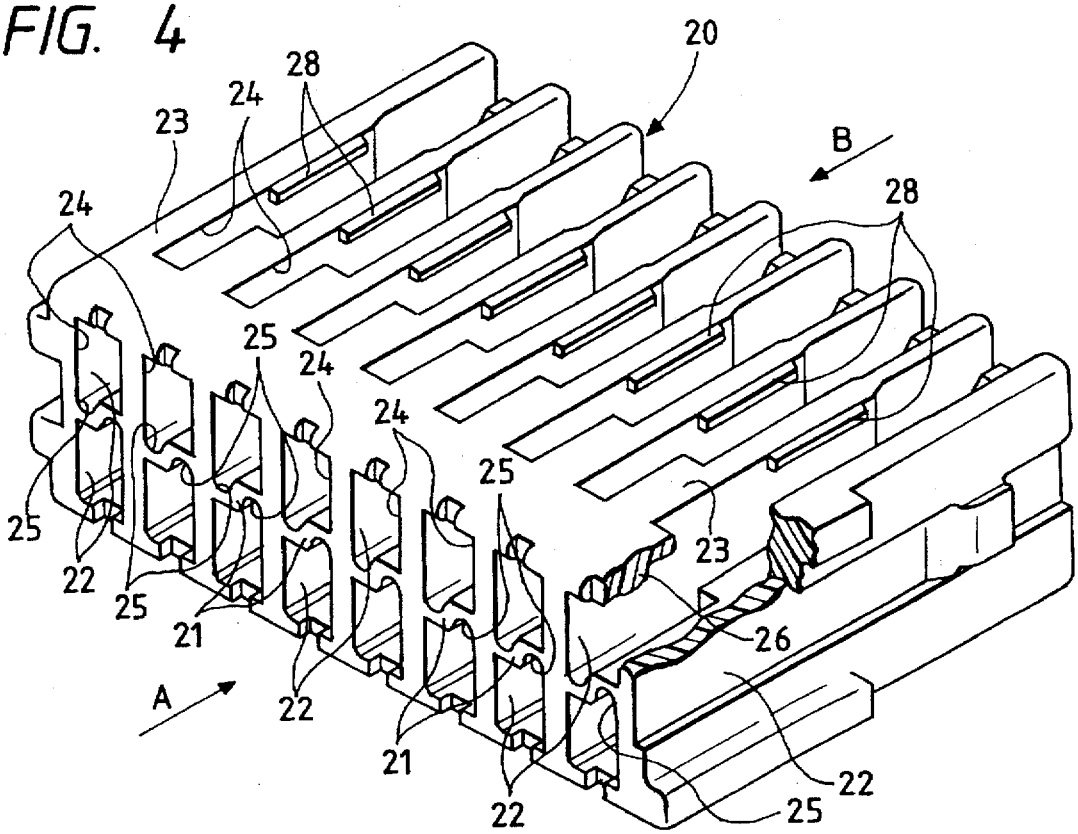
FIG. 4 is a perspective view from the front of a connector body.
Figure 5:
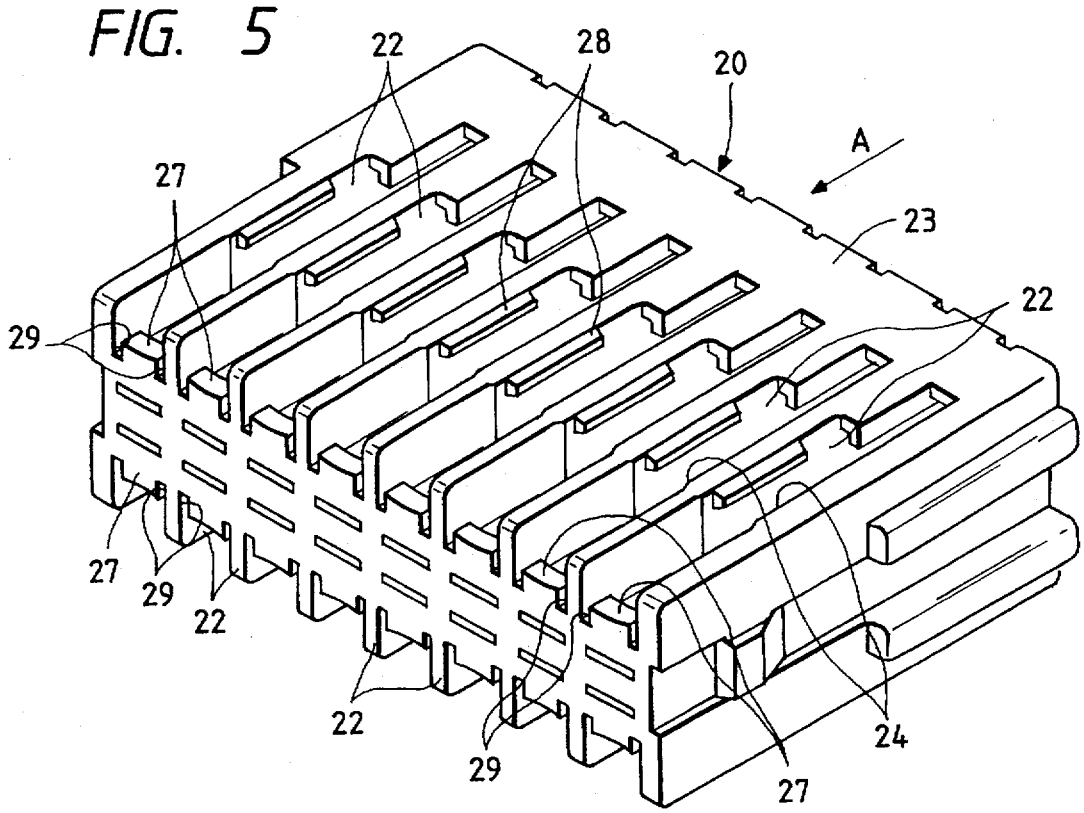
FIG. 5 is an arrow B view of the connector body in FIG. 4.
Figure 6:
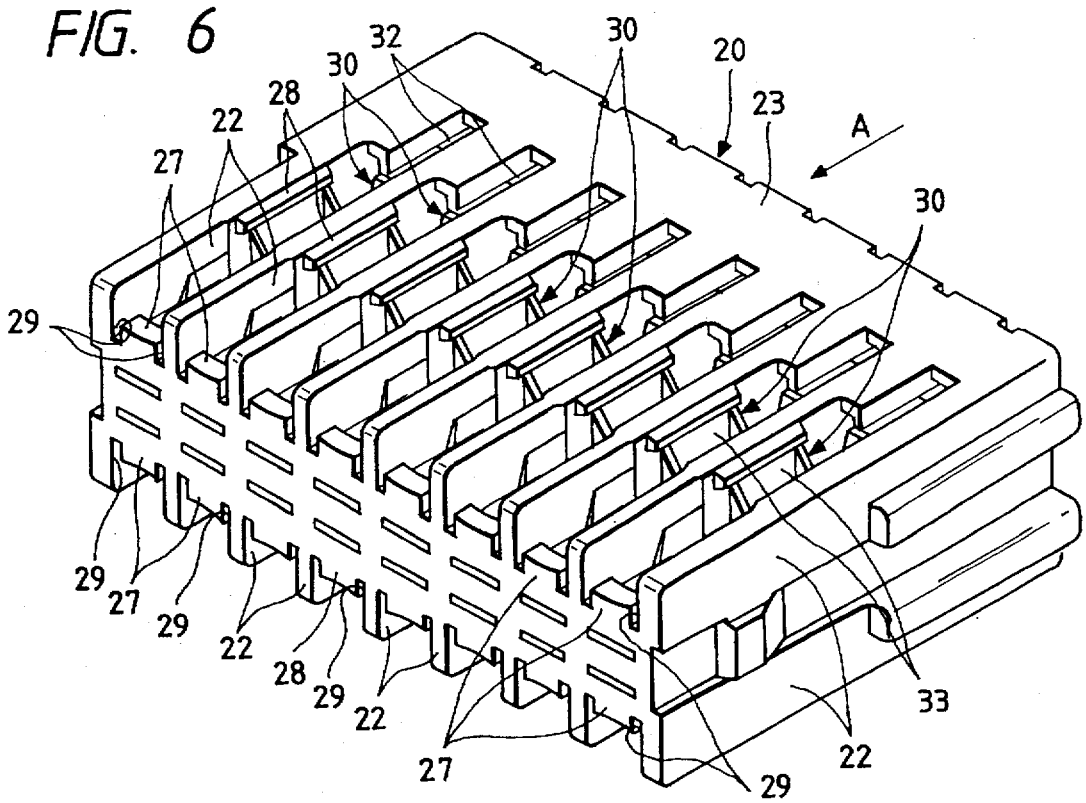
FIG. 6 is a perspective view illustrating the state where terminals are installed in FIG. 5.
Figure 7:
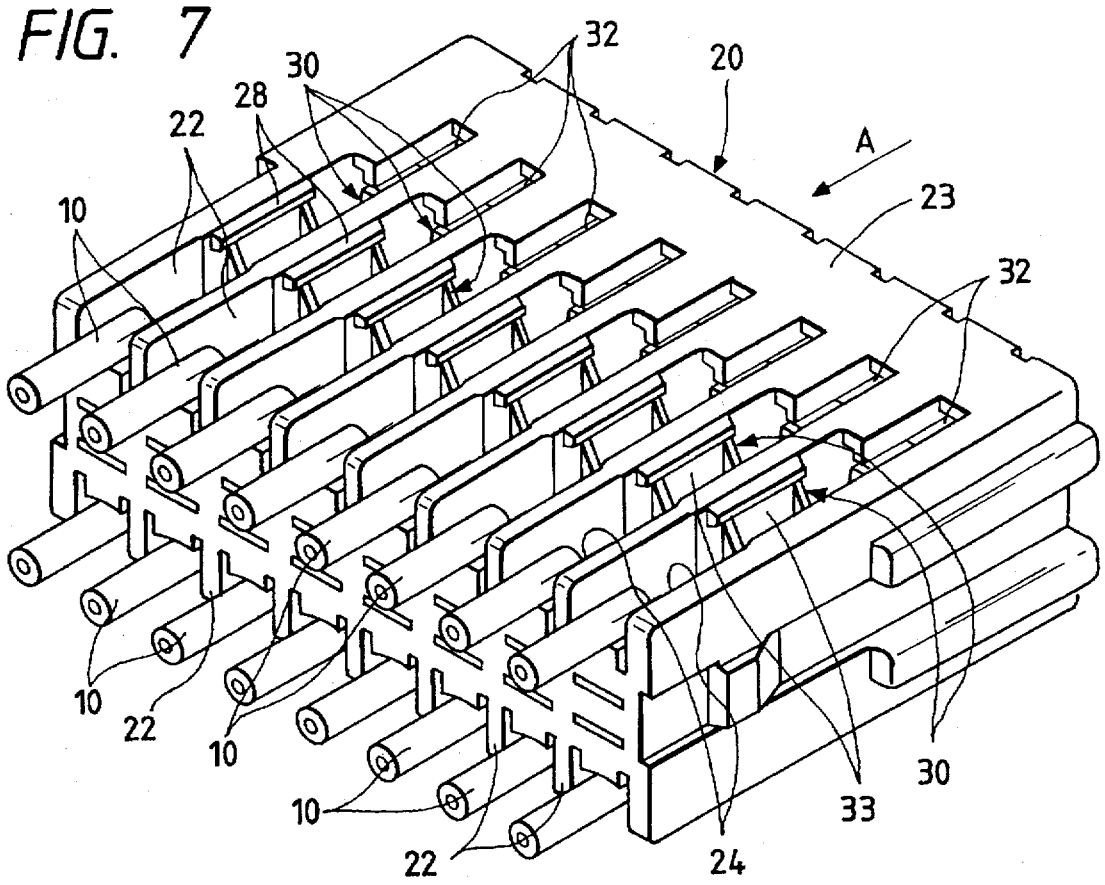
FIG. 7 is a perspective view illustrating the state where electric wires are inserted and connected to the terminals in FIG. 6.

This connector body 20 will be described with reference to FIGS. 4 to 7. FIG. 4 is a perspective view seen from the front of the connector body; FIG. 5 is a perspective view seen from the back in FIG. 4; FIG. 6 is a perspective view showing the state where terminals are installed in FIG. 5; and FIG. 7 is a perspective view showing the state where electric wires are pressed thereto in FIG. 6. In this connector body 20, a plurality of terminal reception chambers 24 defined by a body wall 21, a plurality of side walls 22, and upper and lower walls 23 are provided side by side horizontally and in two stages vertically. Each of the terminal reception chambers 24 has a larger open section than conventional one so that the terminal reception chamber 24 can receive the terminal 30 from the direction of arrow A, that is, from the front side of the connector body 20.

As shown in FIGS. 3 and 4, a first lock groove 25 which can lock a stabilizer 31 as a first claw portion of the terminal 30 is provided in the inner surface of the body wall 21 in each of the terminal reception chambers 24, and a second lock groove 26 which can lock a lance 32 as a second claw portion of the terminal 30 is provided in each of the upper and lower side walls 23. As shown in FIG. 5, a projecting portion 27 is provided so as to project vertically, integrally with a rear end portion of the body wall 21 in each of the terminal reception chambers 24. This projecting portion 27 locks the terminal 30 at a predetermined position to thereby restrain the terminal 30 from moving in the direction of insertion (the direction of arrow A), while an electric wire bending portion is formed along the outer shape of the electric wire 10 fixed to a caulking portion 34 of the terminal 30 to thereby restrain the electric wire 10 from moving backward (in the direction of arrow A).

In the inner surface of the side wall 22 in each of the terminal reception chambers 24, a slot cap member 28 is provided at a position corresponding to a slot portion 33 of the terminal 30. This slot cap member 28 locks the slot portion 33 of the terminal 30 so as to restrain the slot portion 33 from floating.

Figure 8:
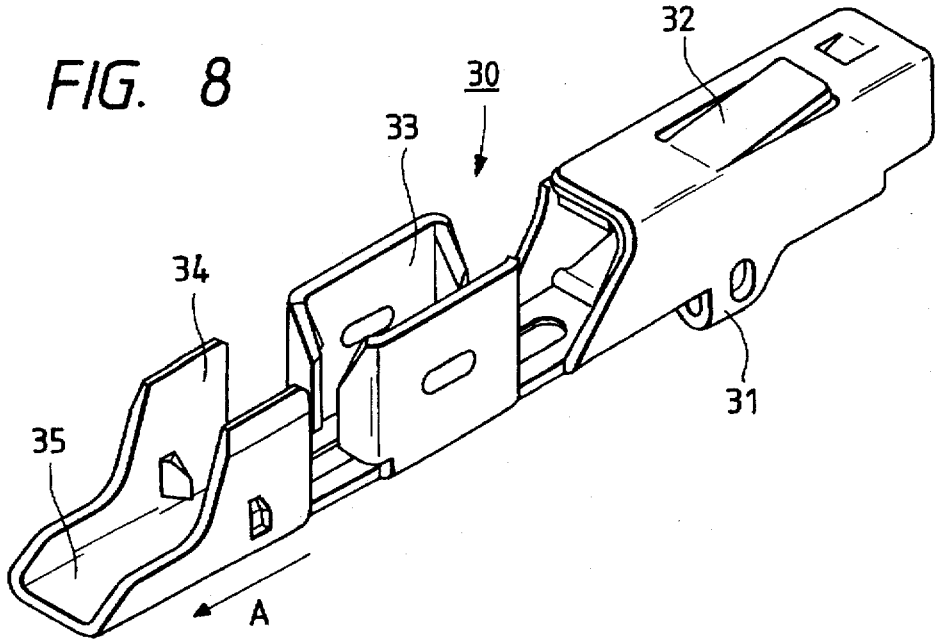
FIG. 8 is a perspective view illustrating a pressure-contact terminal.
Figure 9:
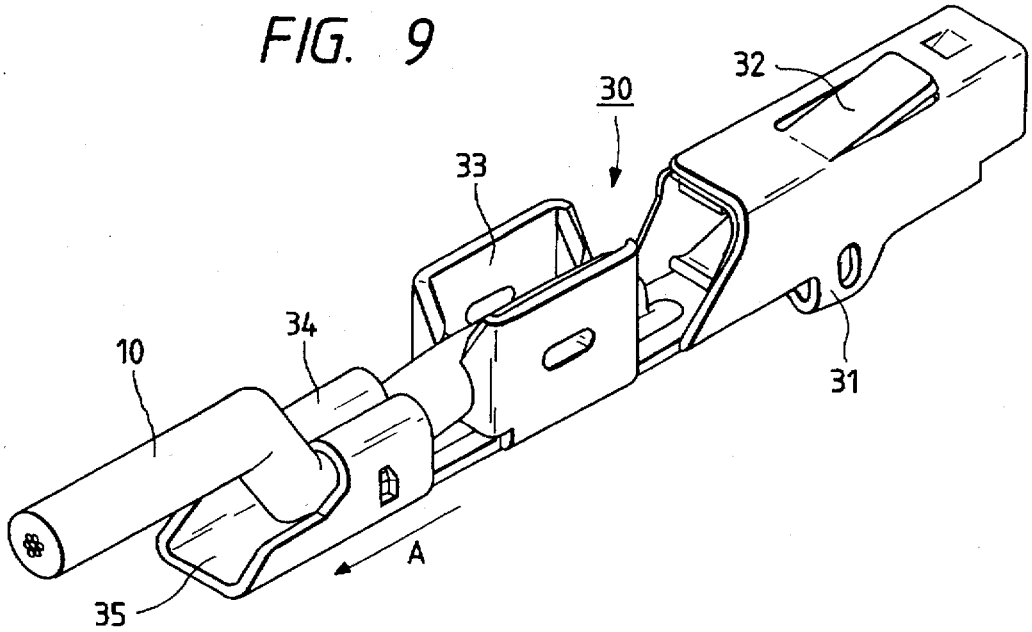
FIG. 9 is a perspective view illustrating the state where electric wires are inserted and connected to the terminals in FIG. 8.

The terminal 30 will be described with reference to FIGS. 8 and 9. As illustrated in the drawings, the electric wire 10 is pressed into the slot portion 33 so that the terminal 30 is electrically connected to the electric wire 10 on one hand, and the caulking portion 34 is caulked so that the terminal 30 pressure-fixes the electric wire 10 on the other hand. A floating preventing piece 35 is provided on an end portion of each of the terminals 30 in the direction of arrow A. This floating preventing piece 35 is fitted into a groove 29 (see FIG. 5) provided in the connector body. Accordingly, by this floating preventing piece 35, the terminal 30 is restrained from moving up/down or floating on one hand, and the terminal 30 is surely prevented, on the other hand, from coming off backward by a backward tensile force, or the like, acting on the electric wire 10.

Figure 10:
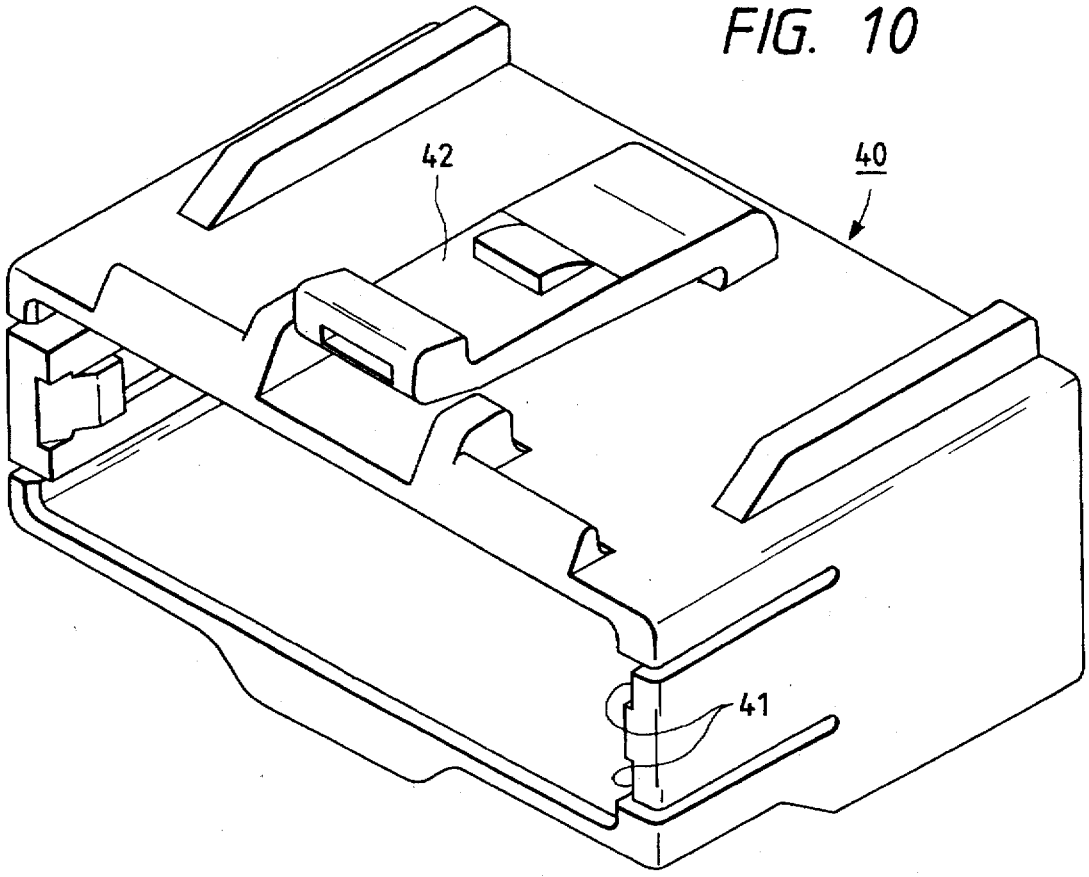
FIG. 10 is a perspective view illustrating a cover.

The cover 40 will be described with reference to FIG. 10. As shown in FIG. 10, the cover 40 is fitted onto the connector body 20 in a manner so that fitting convex portions 20*a* (see FIG. 1) of the connector body are fitted into fitting concave portions 41 formed in an inner surface of the cover 40. A connecting member 42 is provided on the upper surface of this cover 40, and this connecting member 42 is to be fitted into a partner pressure-contact connector (not-shown).

Therefore, as shown in FIG. 3, the cover 40 is connected to the terminal 30, so that the electric wire 10 bent along the shape of the projecting portion 27 of the connector body 20 is held between the cover 40 and the projecting portion 27.

The operation of the pressure-contact connector in this embodiment will be described. The terminals 30 are inserted into the terminal reception chambers 24 of the connector body 20 in the direction of arrow A from the front side of the connector body 20 shown in FIGS. 4 and 5. At this time, the stabilizers 31 of the terminals 30 are locked by the first lock grooves 25 in the respective terminal reception chambers 24 to be thereby restrained from moving in the direction of arrow A, and the lances 32 are locked by the second lock grooves 26 in the respective terminal reception chambers 24 to be thereby restrained from moving in the direction opposite to the direction of arrow A, so that the terminals 30 are positioned at predetermined positions in the respective terminal reception chambers 24.

The projecting portions 27 provided integrally with the connector body 20 lock the terminals 30 in the predetermined positions so as not to move in the direction of arrow A. At the same time, the electric wires 10 pressure-fixed by the caulking portions 34 of the terminals 30 are bent in accordance with the outer shapes thereof, so that the electric wires 10 are restrained from moving in the direction of arrow A and prevented from being rearwardly disengaged from the terminals 30 surely, and so on. Further, the floating preventing pieces 35 provided in the respective terminals 30 are fitted into the grooves 29 of the projecting portions 27 of the connector body 20 when the terminals 30 are received in the respective terminal reception chambers 24 of the connector body 20, so that the terminals 30 are restrained from moving up/down or floating on one hand, and the terminals 30 are restrained from moving backward on the other hand.

Next, the assembling steps of the pressure-contact connector in this embodiment will be described. First, as shown in FIG. 6, a predetermined number of terminals 30 are received respectively in the terminal reception chambers 24 of the connector body 20 in the direction of arrow A. At this time, the stabilizers 31 of the respective terminals 30 are locked by the first lock grooves 25 of the respective terminal reception chambers 24 while the lances 32 of respective terminals 30 are locked by the second lock grooves 26 of the respective terminal reception chambers 24 so that the terminals 30 are restrained from moving in the direction opposite to the direction of arrow A. Further, the floating preventing pieces 35 of the respective terminals 30 are fitted into the grooves 29 of the projecting portions 27 of the connector body 20, so that the terminals 30 are restrained from moving up and down. As a result, the terminals 30 are positioned in the predetermined positions in the respective terminal reception chambers 24.

Next, as shown in FIG. 2, the electric wires 10 are pressure- connected to the slot portions 33 of the respective terminals 30, and the caulking portions 34 are caulked to pressure-contact the electric wires 10 to the terminals 30. At that time, the electric wires 10 are bent by the projecting portions 27 of the connector body 20 in accordance with the outer shapes thereof, so that the electric wires 10 are restrained from moving backward in the direction of insertion (the direction of arrow A).

After that, as shown in FIGS. 1 to 3, the cover 40 is fitted to the connector body 20 in the direction of arrow A so that the bent portions of the electric wires 10 are held between the cover 40 and the connector body 20. Thus, the assembling process is completed.

As has been described above, according to the above-mentioned embodiment, the terminals 30 to which the electric wires 10 are to be connected are received in the terminal reception chambers 24 from the front side of the connector body 20 opposite to the side where the electric wires 10 are inserted, and the terminals 30 are positioned at predetermined positions in the respective terminal reception chambers 24. That is, the stabilizers 31 are locked by the first lock grooves 25, and the lances 32 are locked by the second lock grooves 26 so that the terminals 30 received in the respective terminal reception chambers 24 are restrained from moving in the direction opposite to the direction of arrow A.

Since the terminals 30 are therefore positioned in the predetermined positions in the respective terminal reception chambers 24, it is not necessary to provide such a housing lance in the connector body 20 as in the conventional case, and the space necessary for releasing the housing lance is not required. Therefore, not only it is possible to surely hold the terminals 30 and the electric wires 10 in the connector body 20, but also it is easy to install the terminals 30 and the electric wires 10 into the connector body 20 automatically. Accordingly, it is possible to reduce the number of parts and the number of assembling steps so as to reduce the connector in size as well as in cost.

In addition, in the end portions of the respective terminal reception chambers 24, into which the electric wires 10 are to be inserted, the projecting portions 27 are integrally provided so as to project vertically, and the respective projecting portions 27 lock the terminals 30 in predetermined positions to thereby restrain the terminals 30 from moving in the direction of arrow A. Further, the electric wires 10 fixed to the caulking portions 34 of the terminals 30 are bent along the outer shapes of the latter, so that the electric wires 10 are restrained from moving in the direction of arrow A. It is therefore possible to hold the electric wires 10 by the connector body 20 surely.

That is, since the terminals 30 are received in the terminal reception chambers 24 of the connector body 20 from the side opposite to the side where the electric wires 10 are inserted, it is not necessary to provided the projecting portions 27 separately from the connector body 20 as in the conventional case, but it is possible to provide the projecting portions 27 integrally with the terminal reception chambers 24 of the connector body 20 at its end portion on the side where the electric wires 10 are to be inserted. Accordingly, a strain relief structure for preventing the electric wires from coming off backward can be formed easily and compactly.

Further, the floating preventing pieces 35 are provided on the end portions of the respective terminals 30 in the direction of arrow A. When the terminals 30 are received in the terminal reception chambers 24 of the connector body 20, the floating preventing pieces 35 are fitted into the grooves 29 of the projecting portions 27 so as to restrain the terminals 30 from moving up and down. It is therefore possible to reduce the number of parts and the number of assembling steps and reduce the connector in size as well as in cost. In addition, even if a tensile force acts on the electric wires 10 connected to the terminals 30, it is possible to surely prevent the terminals 30 in the respective terminal reception chambers 24 from floating, and so on.

Figure 11:
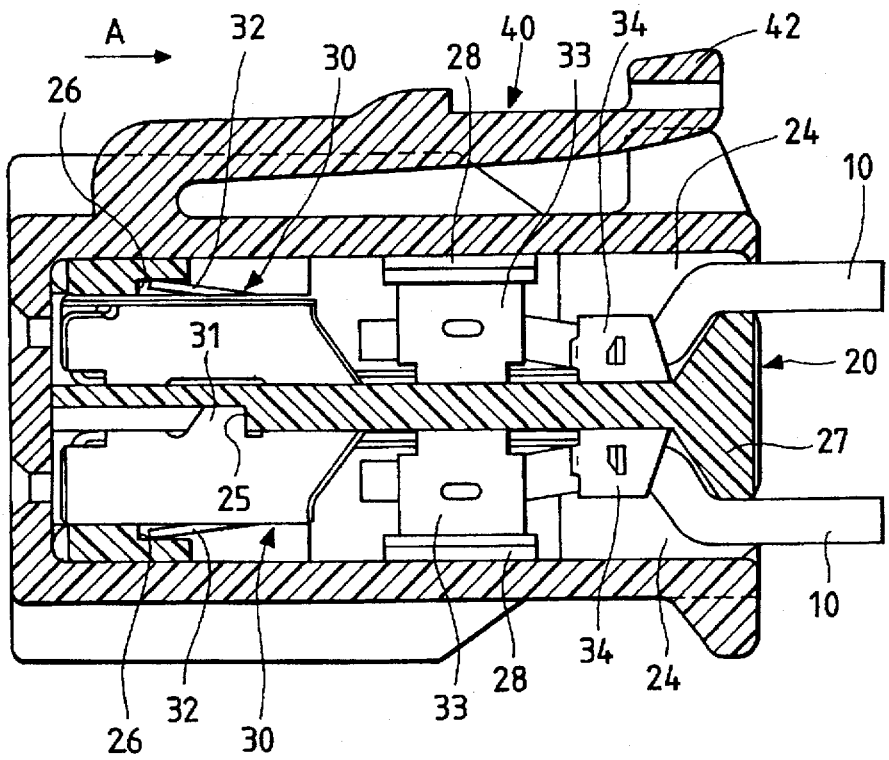
FIG. 11 is a sectional view illustrating a pressure-contact connector which is another embodiment of the present invention.
Figure 12:
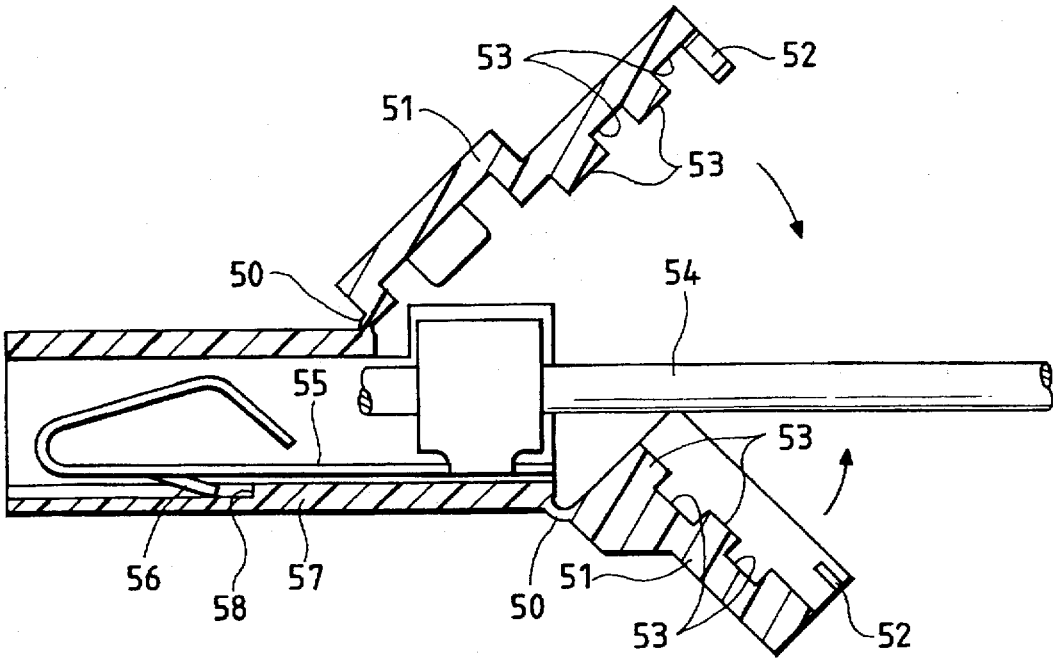
FIG. 12 PRIOR ART
FIG. 12 is a sectional view illustrating a conventional pressure-contact connector which has not held a lead wire.
Figure 13:
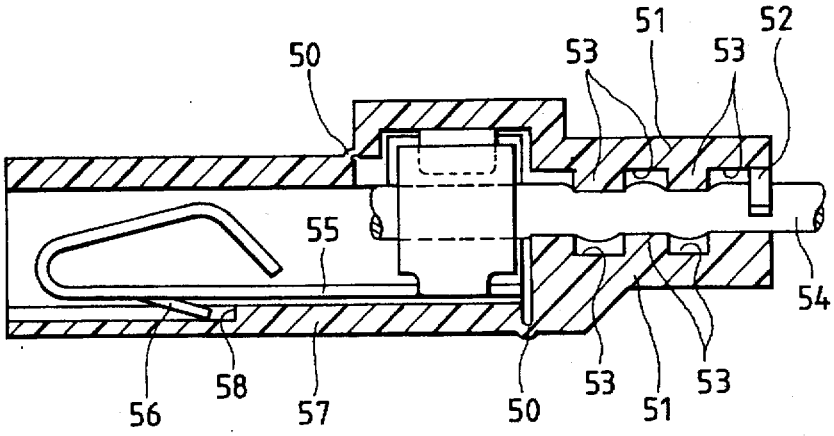
FIG. 13 PRIOR ART
FIG. 13 is a sectional view illustrating the state after a lead wire has been held in FIG. 12.
Figure 14:
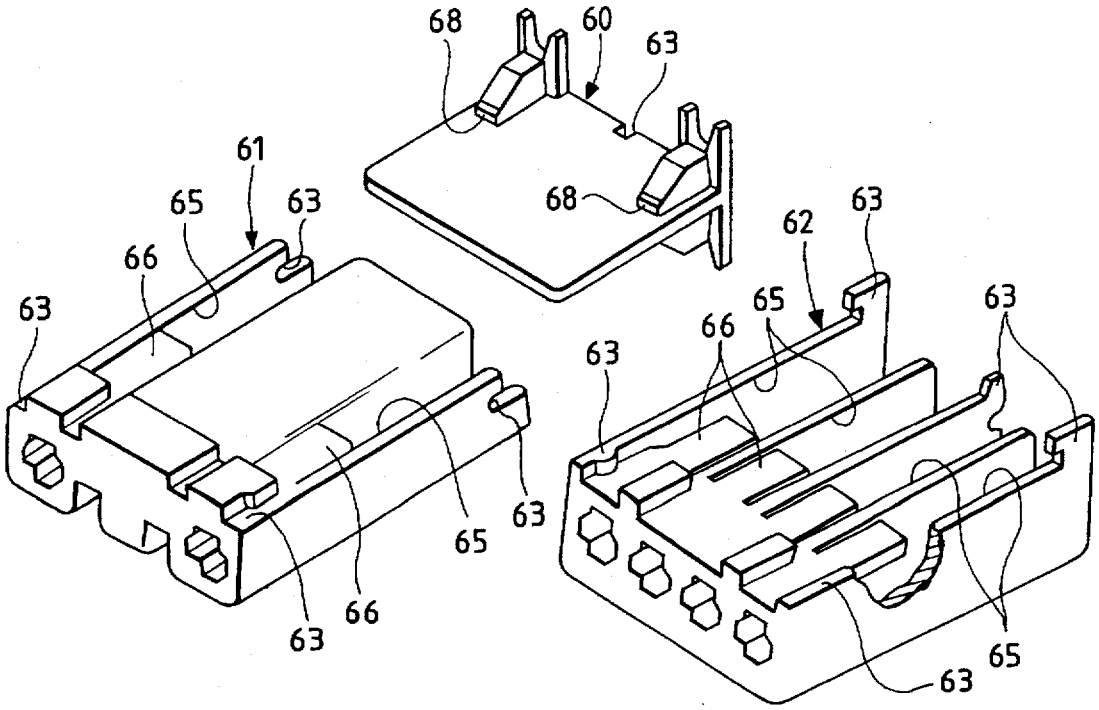
FIG. 14 PRIOR ART
FIG. 14 is an exploded perspective view illustrating another conventional pressure-contact connector.
Figure 15:
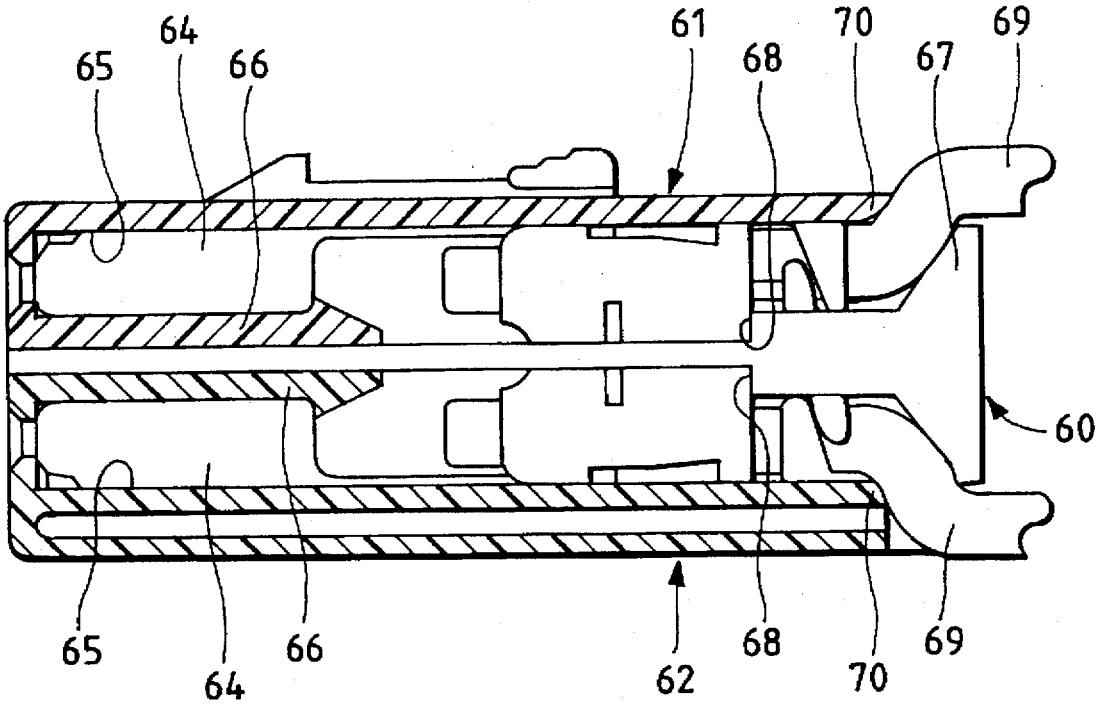
FIG. 15 PRIOR ART
FIG. 15 is a sectional view illustrating the state where assembling is completed in FIG. 14.

Although in the above embodiment, the floating preventing pieces 35 are provided on the end portions of the respective terminals 30 in the direction of arrow A, while the grooves 29 into which the floating preventing pieces 35 are to be fitted are provided in the respective projecting portions 27 of the connector body 20, the connector can be designed without providing such floating preventing pieces and grooves as shown in FIG. 11. In this case, floating, or the like, of the terminals 30 can be prevented by the slot cap members 28 sufficiently, and a strain relief structure which can cope with a larger tensile force can be formed if the strength of the projecting portions 27 is increased.

Although the number of the terminal reception chambers 24 provided in the connector body 20 is 8 in each of upper and lower stages, 16 in total, in the above embodiment, the number of the terminal reception chambers 24 can be increased if a plurality of such connector bodies 20 are piled up to more multi-stages, for example, 4 or 6 stages, and a plurality of covers are provided correspondingly.

As has been described, in the pressure-contact connector according to the present invention, terminals to which electric wires are to be connected are stored in terminal reception chambers from the front side of a connector body, and positioned in predetermined positions in the terminal reception chambers by positioning means, so that it is possible to surely hold the terminals and the electric wires in the connector body, and it is possible to reduce the number of parts and the number of assembling steps. It is therefore possible to reduce the connector in size as well as in cost.

In addition, the positioning means are constituted by first and second claw portions provided in the terminals, and first and second lock grooves provided in the terminal reception chambers of the connector body. Accordingly, the terminals are restrained from moving in the direction of insertion as well as in the direction opposite to the direction of insertion. Consequently, the terminals are positioned in the predetermined positions in the terminal reception chambers easily and surely.

In addition, projecting portions are provided integrally with the terminal reception chambers of the connector body on their end portions where the electric wires are to be inserted. Accordingly, the projecting portions not only restrain the terminals from moving backward and position the terminals in the predetermined positions, but also bend the electric wires along the outer shapes thereof to thereby prevent the electric wires from coming off backward. Accordingly, it is possible to hold the electric wires in the connector body surely.

Further, floating preventing pieces are provided on the terminals at their end portions in the direction of insertion of the terminals into the connector body. Accordingly, it is possible to surely prevent the terminals from floating from the connector body even if a tensile force acts on the electric wires.

What is claimed is:

1. A pressure-contact connector comprising:

a connector housing having a plurality of terminal accommodating chambers;

a plurality of terminals insertable into said plurality of terminal accommodating chambers in a rearward direction from a front side of said connector housing, said front side of said connector housing corresponding to a side of said housing which receives mating terminals associated with a mating connector;

positioning means for positioning said terminals in predetermined positions in said terminal accommodating chambers, said positioning means being provided in said terminals and said connector body; and projecting portions provided at rear ends of said terminal accommodating chambers of said connector housing corresponding to a rear side from which electric wires are inserted so that said projecting portions project in a direction intersecting the direction of insertion of said electric wires, said terminals being restrained from moving backward by said projecting portions and said electric wires connected to said terminals being prevented from rearwardly disengaging from said terminals, wherein said connector housing and said projecting portions are unitarily formed as a single piece of material.

2. A pressure-contact connector according to claim 1, wherein said positioning means includes:

first and second claw portions provided in said terminals; and first and second lock grooves, provided in said terminal accommodating chambers of said connector housing, for locking said first and second claw portions respectively, so that said first claw portion is locked by said first lock groove to be thereby restrained from moving in the rearward direction while said second claw portion is locked by said second lock groove to be thereby restrained from moving in a forward direction opposite to the rearward direction.

3. A pressure-contact connector according to claim 1, wherein said terminals include floating prevention members which are retained by said projecting portions respectively provided at rear ends of said terminals.

4. The pressure-contact connector according to claim 1, further comprising a cover for covering said connector housing, said cover including a plurality of holes respectively aligned with said terminal accommodating chambers in which said mating terminals are respectively received.

* * * * *